US007882942B2

(12) United States Patent
Sakai et al.

(10) Patent No.: US 7,882,942 B2
(45) Date of Patent: Feb. 8, 2011

(54) COIN BAR STORAGE

(75) Inventors: Keiji Sakai, Tokyo (JP); Eiko Hibari, Kazo (JP)

(73) Assignee: Laurel Precision Machines Co., Ltd., Osaka-shi (JP)

( * ) Notice: Subject to any disclaimer, the term of this patent is extended or adjusted under 35 U.S.C. 154(b) by 264 days.

(21) Appl. No.: 12/068,155

(22) Filed: Feb. 4, 2008

(65) Prior Publication Data

US 2008/0188169 A1 Aug. 7, 2008

(30) Foreign Application Priority Data

Feb. 7, 2007 (JP) ..... P2007-028474

(51) Int. Cl.
*G07D 5/08* (2006.01)

(52) U.S. Cl. ..... 194/320; 194/213; 194/216; 453/2; 453/16; 453/58; 453/61; 221/196; 221/263; 700/236; 700/242; 700/244; 700/231

(58) Field of Classification Search ..... 194/215–217, 194/210–213, 303, 320; 453/16, 17, 1, 2, 453/58–62; 221/6, 129, 131, 132, 196, 263; 700/231, 236, 237, 240–244
See application file for complete search history.

(56) References Cited

U.S. PATENT DOCUMENTS

| | | | | |
|---|---|---|---|---|
| 5,756,977 | A | 5/1998 | Biss | |
| 5,805,456 | A * | 9/1998 | Higham et al. | 700/236 |
| 6,267,662 | B1 * | 7/2001 | Jard et al. | 453/17 |
| 2005/0156033 | A1 | 7/2005 | Van Rens | |
| 2009/0166227 | A1 * | 7/2009 | Imai et al. | 206/81 |
| 2009/0171498 | A1 * | 7/2009 | Tabata et al. | 700/214 |

FOREIGN PATENT DOCUMENTS

| | | | |
|---|---|---|---|
| EP | 0 724 242 | A2 | 7/1996 |
| EP | 1 879 155 | A1 | 1/2008 |
| FR | 2 586 840 | A1 | 3/1987 |
| JP | 2006-85332 | | 3/2006 |
| JP | 2006285472 | * | 10/2006 |
| WO | WO 03/079299 | A | 9/2003 |
| WO | 2006-040835 | A1 | 4/2006 |
| WO | WO 2006/109400 | A1 | 10/2006 |

OTHER PUBLICATIONS

Derwent Translation of JP2006285472.*
JPO translation of JP2006285472.*
Chinese Office Action issue in CN 200810005499.X on Dec. 4, 2009 with English translation.

* cited by examiner

*Primary Examiner*—Jeffrey A Shapiro
(74) *Attorney, Agent, or Firm*—Nixon & Vanderhye P.C.

(57) ABSTRACT

A coin bar storage of the invention includes: a casing; a coin bar tray that is provided in the casing so as to be drawn out from and stored into the casing, and that has a plurality of set sections in which set coin types are respectively pre-set to assign a coin type to each of the set sections; a set coin type presence confirmation section that is provided in all of the set sections of the coin bar tray, that respectively confirms whether or not coin bars of the set coin types is set, and that outputs a confirmation result; and a management section that manages a present amount of coin bars in the coin bar tray based on the confirmation result from the set coin type presence confirmation section.

3 Claims, 7 Drawing Sheets

*FIG. 3*

| Type | Component | Wt. | Dia. | Hole dia. | Thickness | Conductivity | Wt. of 50 coins | Length of a coin bar including 50 coins |
|---|---|---|---|---|---|---|---|---|
| 500 yen nickel brass coin | Copper a, Zinc b, Nickel c | 7.00 | 26.5 | | 1.80 | p | 350 | 90 |
| 500 yen cupronickel coin | Copper d, Nickel e | 7.20 | 26.5 | | 1.80 | q | 360 | 90 |
| 100 yen cupronickel coin | Copper d, Nickel e | 4.80 | 22.6 | | 1.70 | q | 240 | 85 |
| 50 yen cupronickel coin | Copper d, Nickel e | 4.00 | 21.0 | 4.0 | 1.75 | q | 200 | 87.5 |
| 10 yen bronze coin | Copper f, Zinc g, Tin h | 4.50 | 23.5 | | 1.50 | r | 225 | 75 |
| 5 yen brass coin | Copper j, Zinc k | 3.75 | 22.0 | 5.0 | 1.50 | s | 187.5 | 75 |
| 1 yen aluminum coin | Aluminum m | 1.00 | 20.0 | | 1.50 | t | 50 | 75 |

COIN BAR STORAGE

BACKGROUND OF INVENTION

1. Field of the Invention

The present invention relates to a coin bar storage that stores coin bars while allowing them to be taken out as necessary.

Priority is claimed on Japanese Patent Application No. 2007-028474, filed Feb. 7, 2007, the content of which is incorporated herein by reference.

2. Description of Related Art

Japanese Unexamined Patent Application, First Publication, No. 2006-85332 discloses a system in which a cash depositing/dispensing machine for depositing sales cash and for dispensing change cash is adjunctively provided with a POS register that manages sales cash. Furthermore, in this system, there is adjunctively provided a coin bar storage that stores coin bars for reloading change coins. This coin bar storage has a casing and a coin bar tray that is provided in the casing so as to be able to be drawn out from and stored into the casing. When the coin bar tray that has been drawn out from the casing is being stored into the casing, this coin bar storage counts coin bars that are moving together with the coin bar tray with respect to the casing by scanning the coin bars with a sensor provided in the casing, thereby carrying out management of a present amount of coin bars.

However, if the coin bars are to be counted by scanning them with the sensor while making use of the movement of the coin bar tray, a present amount of coin bars cannot be detected unless the coin bar tray is drawn out and returned. As a result, there is a problem in that detection of a present amount of coin bars cannot be carried out at an arbitrary timing.

SUMMARY OF THE INVENTION

An object of the present invention is to provide a coin bar storage capable of detecting a present amount of coin bars at arbitrary timing.

In order to achieve the above object, the coin bar storage of the present invention includes: a casing; a coin bar tray that is provided in said casing so as to be drawn out from and stored into said casing, and that has a plurality of set sections in which set coin types are respectively pre-set to assign a coin type to each of said set sections; a set coin type presence confirmation section that is provided in all of said set sections of said coin bar tray, that respectively confirms whether or not coin bars of the set coin types is set, and that outputs a confirmation result; and a management section that manages a present amount of coin bars in said coin bar tray based on the confirmation result from said set coin type presence confirmation section.

According to the present invention, the coin bar tray has a plurality of the set sections in which coin types of the coin bars to be set are respectively pre-set to assign a coin type to each of the set sections. In all of these set sections, there are provided set coin type presence confirmation sections that confirm the presence of coin bars of the set coin types. The management section detects a present amount of coin bars by having the respective set coin type presence confirmation sections detect the presence of coin bars of the set coin types in the corresponding set sections. As described above, in all of these set sections, there are provided set coin type presence confirmation sections that detect the presence of coin bars of the set coin types. As a result, a present amount of coin bars can be detected at arbitrary timing. Moreover, at the set sections, there are pre-set coin types of coin bars to be set. Therefore, the set coin type presence confirmation section only needs to detect whether the coin bar of the set coin type is in a state of having been set, or in other states (no coin bar is present, a coin bar of a different coin type is set, an object other than a coin bar is set, or an abnormal coin bar is set). Therefore, the configuration and control can be simplified and a cost reduction can be realized. Furthermore, it is detected whether a coin bar of the set coin type is in a state of having been set, or in other states. Therefore, a detection of an incorrect amount of coin bars can be prevented in a state where a coin bar of an incorrect set coin type other than the set coin type is set in the set section.

The coin bar storage of the present invention may be such that it has a storage detection section that detects an open-closed switching from an open state where said coin bar tray is drawn out from said casing into a closed state where said coin bar tray is stored into said casing, wherein said management section detects the present amount when the open-closed switching is detected by said storage detection section.

According to this configuration, when the storage detection section detects the open-closed switching where the coin bar tray is drawn out from the casing is stored into the casing, the management section detects the present amount of coin bars. As a result, the present amount of coin bars can be automatically detected at the time of storing the coin bar tray after the coin bar tray is drawn out, where the present amount of stored coin bars is likely to change.

The coin bar storage of the present invention may be such that it has a power supply monitoring section that detects an OFF-ON switching of an external power supply from OFF to ON, wherein said management section detects the present amount when said OFF-ON switching is detected by said power supply monitoring section.

According to this configuration of the present invention, the management section detects the present amount of coin bars when an OFF-ON switching in the external power supply from OFF to ON is detected by the power supply monitoring section. Accordingly, even if there occurs an unstable situation for managing the coin bars such as a power failure or an interruption, where the external power supply is turned OFF and coin bar management is difficult to perform, then the present amount of coin bars can be immediately detected after this at the point when the power supply has been restored. Therefore, even if there occurs a management problem in a situation where it is difficult to perform coin bar management, the present amount can be immediately detected and the problem can be thereby immediately handled.

The coin bar storage of the present invention may be such that said set coin type presence confirmation section includes: a weight sensor that performs detection of a weight of a coin bar set in said set section and outputs a detection result; and a confirmation section that confirms whether or not a coin bar of a set coin type is set in a detected set section where the detection is carried out, based on whether or not the detection result matches with a reference weight of a coin bar of a set coin type pre-set to said detected set section, within an allowable range.

A coin bar configured by packing a prescribed number of coins has a weight that sufficiently enables identification of a coin type. Therefore, according to this configuration, the confirmation section is capable of confirming the presence of the coin bar of the set coin type, based on whether or not the weight of the coin bar set in the set section that is detected by the weight sensor matches with the reference weight of the coin bar of the set coin type within an allowable range. Therefore, with such a simple configuration, the presence of the coin bar of the set coin type can be reliably detected.

The coin bar storage of the present invention may be such that said set section is configured so that a set height of a set coin bar that is set in said set section becomes different depending on an outer diameter of the set coin bar; and said set coin type presence confirmation section includes: a distance sensor that performs detection of the set height of the set coin bar and outputs a detection result; and a confirmation section that confirms whether or not a coin bar of a set coin type is set in a detected set section where the detection is carried out, based on whether or not the detection result matches with a reference set height of a coin bar of a set coin type pre-set to said detected set section, within an allowable range.

A coin bar configured by packing coins having a prescribed outer diameter has an outer diameter that sufficiently enables identification of a coin type. Therefore, according to this configuration, the presence of a coin bar of a set coin type can be detected as described below. The set height of the set section is made different by making use of a difference in the outer diameters of the coin bars. The set height of the coin bar set in the set section is detected by the distance sensor. The confirmation section confirms the presence of a coin bar of the set coin type based on whether or not this detected set height matches with the reference set height of the coin bar of the set coin type within the allowable range. Therefore, with such a simple configuration, the presence of the coin bar of the set coin type can be reliably detected.

The coin bar storage of the present invention may be such that said set section has a pair of supporting faces with a shape in which a gap therebetween becomes narrower downward, and by supporting an outer periphery of the set coin bar on said supporting faces, the set height of the set coin bar is made different depending on an outer diameter of the set coin bar.

According to this configuration, by supporting the coin bar on the pair of supporting faces with a shape in which the gap therebetween becomes narrower downward, the set section makes the set height of the coin bar different for each outer diameter. Therefore, with such a simple configuration, the set height of the coin bar can be made different for each outer diameter of a coin bar.

The coin bar storage of the present invention may be such that the set section has a pair of supporting points arranged with a gap which is narrower than an outer diameter of a coin bar of a coin type with a smallest diameter when seen from an axial direction of the set coin bar, and by supporting the outer periphery of the set coin bar on said supporting points, the set height of the set coin bar is made different depending on the outer diameter of the set coin bar.

According to this configuration, the set section has the pair of supporting points arranged with a gap which is narrower than the outer diameter of the coin bar of the coin type with the smallest diameter when seen from the axial direction of the coin bar set in the set section. By supporting the outer periphery of the coin bar on these supporting points of the set section, the set height of the coin bar is made different depending on the outer diameter of the coin bar. Therefore, with such a simple configuration, the set height of the coin bar can be made different depending on the outer diameter value of the coin bar.

The coin bar storage of the present invention may be such that said set section is configured so that a set height of a set coin bar that is set in said set section becomes different depending on an outer diameter of the set coin bar, said set coin type presence confirmation section includes: a magnetic sensor that performs detection of a magnetic characteristic of the set coin bar and outputs a detection result, and a confirmation section that confirms whether or not a coin bar of a set coin type is set in a detected set section where the detection is carried out, based on the detection result.

According to this configuration, the set height of the set section is made different by making use of differences in the outer diameters of the coin bars. Thereby, the confirmation section can confirm the presence of the coin bar of the set coin type based on the output of the magnetic sensor (the magnetic characteristic of the coin bar set in the set section) that changes according to the material of the coin bar and the distance between the coin bar and the magnetic sensor. Furthermore, a difference in the materials of the coin bars can also be detected. Therefore, if a coin bar, the diameter of which is the same as that of the coin bar of the set coin type, and the material of which is different from that of the coin bar of the set coin type, is mixed for example, then this can be detected.

The coin bar storage of the present invention may be such that said set coin type presence confirmation section includes two magnetic sensors that detect a magnetic characteristic of a set coin bar that is set in said set section and that respectively output a detection result, and said two magnetic sensors are arranged in said set section spaced apart in an axial direction of the set coin bar, said set section is configured such that a set height of the set coin bar in a position of one of said magnetic sensors is constant regardless of an outer diameter of the set coin bar, while a set height of the set coin bar in a position of the other magnetic sensor is different depending on the outer diameter of the set coin bar, said two magnetic sensors are configured such that in a case where a coin bar of a set coin type is set in said set section, the respective detection results are balanced, and said confirmation section confirms whether or not a coin bar of a set coin type is set in said set section based on whether or not the respective detection results from said two magnetic sensors are balanced.

According to this configuration, in a state where a coin bar of the set coin type is set in the set section, the output results from one magnetic sensor and from the other magnetic sensor are balanced. In other states, the balance in output results from both of the magnetic sensors is impaired. The confirmation section confirms the presence of a coin bar of the set coin type based on whether or not the respective detection results from such two magnetic sensors are balanced. The balance in the outputs from such two magnetic sensors is also observed even in the case where the difference in diameters is small. Accordingly, the presence of a coin bar of the set coin type can be reliably detected. Furthermore, exogenous noise can be canceled by observing the balance in the outputs of these two magnetic sensors. As a result, reliability of the detection results is improved.

BRIEF DESCRIPTION OF THE DRAWINGS

FIG. 3 is a table showing various data of coin bars of respective types of coins.

DETAILED DESCRIPTION OF THE INVENTION

Hereinafter, a coin bar storage of a first embodiment of the present invention is described, with reference to FIG. 1 to FIG. 6B.

Figure 1:
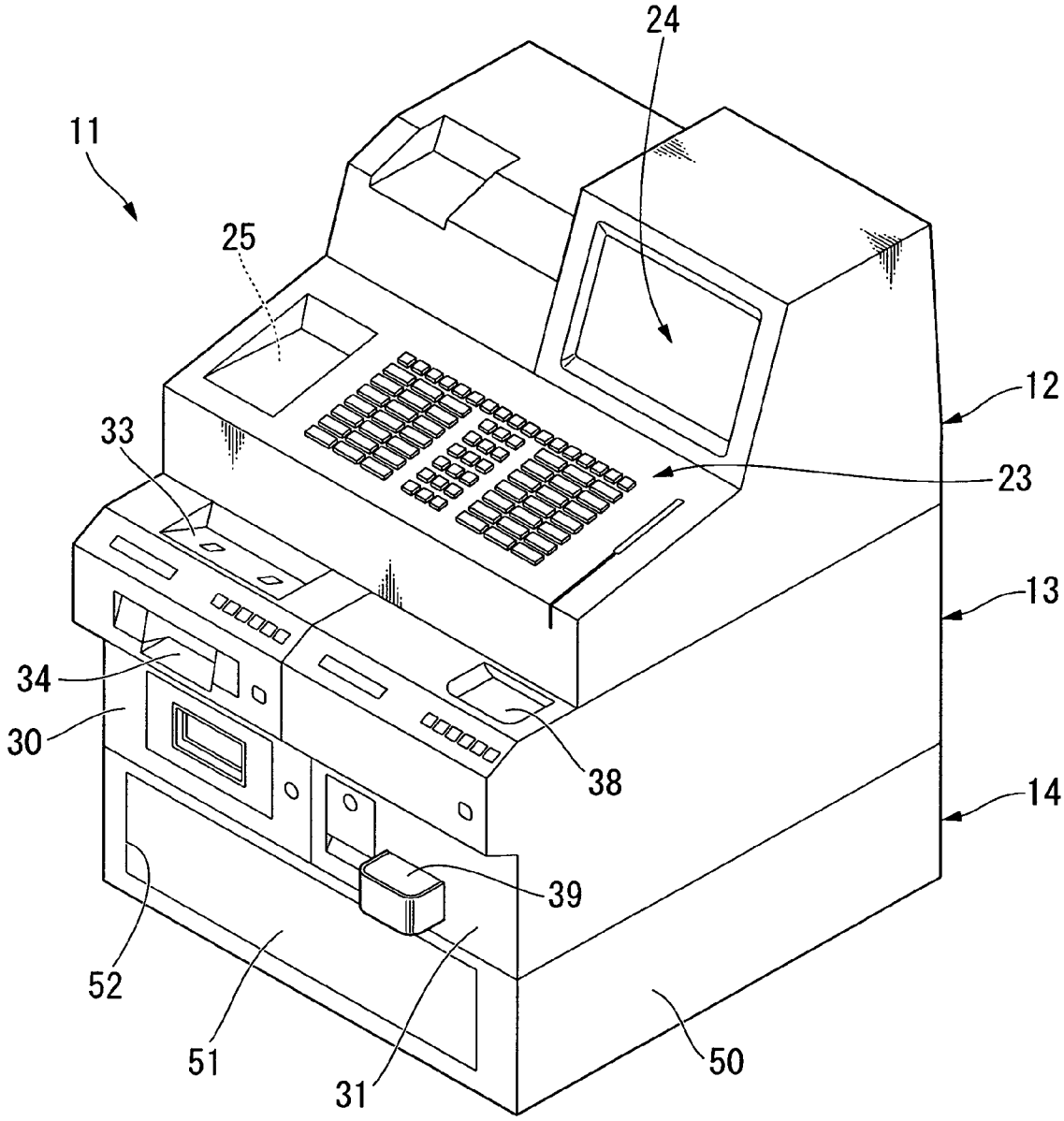
FIG. 1 is an overall perspective view of a register apparatus to which a coin bar storage of a first embodiment of the present invention is applied.

FIG. 1 shows a register apparatus 11 that is for example used at a supermarket. This register apparatus 11 is configured essentially with a POS register 12, a cash depositing/dispensing machine 13, and a coin bar storage 14 of the first embodiment. The POS register 12 is operated by a register operator to carry out sales cash management. The cash depositing/dispensing machine 13 is provided on the lower side of the POS register 12, and synchronizes with the POS register 12 to receive sales cash and dispense change cash. The coin bar storage 14 of the first embodiment is provided on the lower side of the cash depositing/dispensing machine 13 and stores coin bars to be used for reloading change cash.

Figure 2:
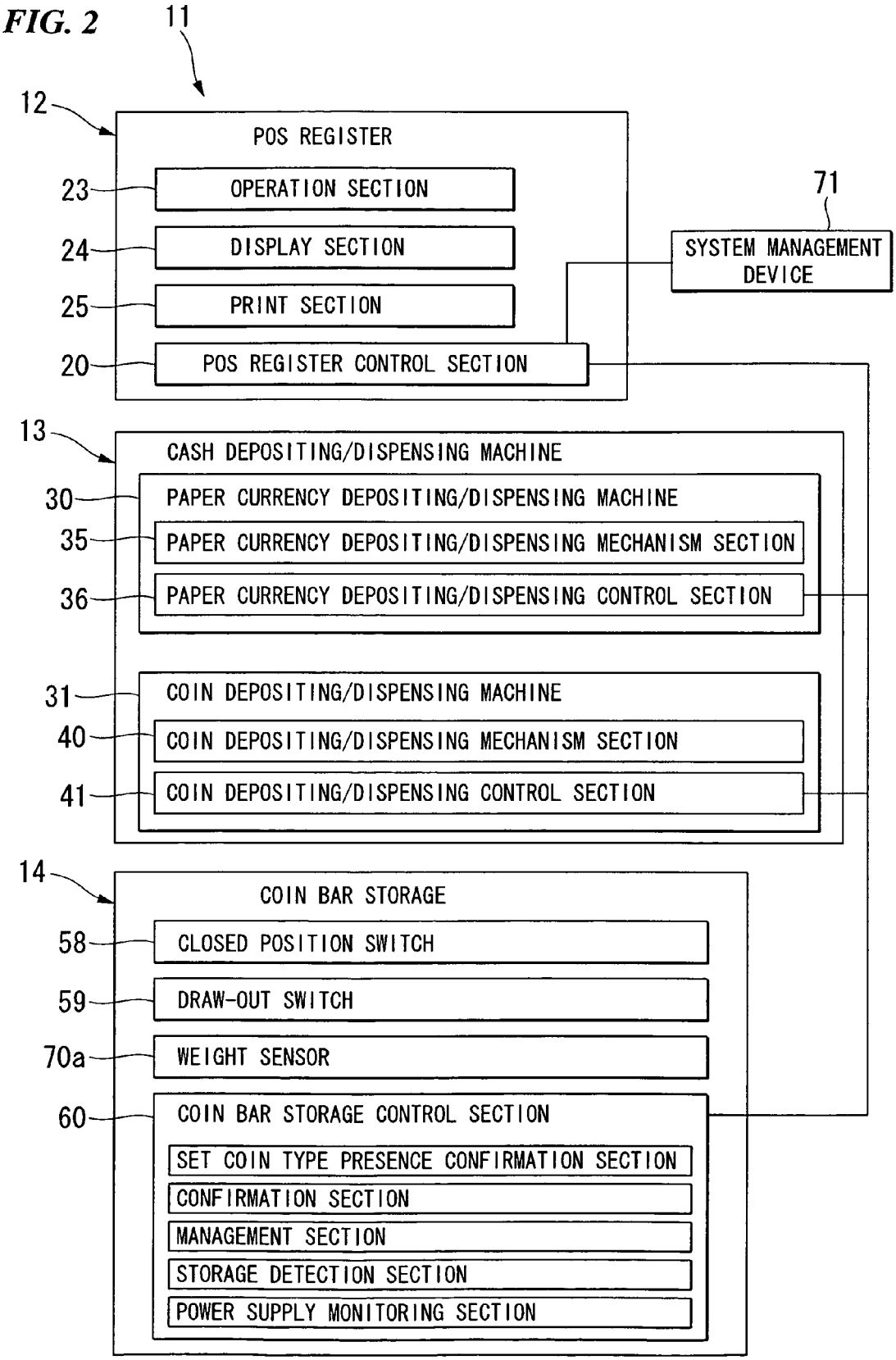
FIG. 2 is a block diagram of a control system of the register apparatus to which the coin bar storage of the first embodiment of the present invention is applied.

As shown in FIG. 2, the POS register 12 is provided with; a POS register control section 20, an operation section 23, a display section 24, and a print section 25. The POS register control section 20 has a calculation function for calculating a total price amount of merchandise based on bar-codes of the merchandise scanned with a bar-code scanner (not shown in the drawing). The operation section 23 has a totaling key to be operated by the operator to complete a bar-code scanning operation and amount input keys to be operated by the operator to input an amount of cash received from a customer. The display section 24 displays a calculated total price amount of the merchandise and guidance for the operator. The print section 25 prints out names of the purchased merchandise, prices of the merchandise, and a total price of the merchandise on a receipt.

In this POS register 12, when an operation of scanning bar-codes of merchandise is completed and the totaling key on the operation section 23 is pressed down, the following process is carried out. First, the POS register control section 20 displays a total price amount of the merchandise on the display section 24. Next, a difference between the payment received from the customer and the purchased price of the merchandise is calculated. Then, in the case where there is a difference between the payment received from the customer and the purchased price, a change command for dispensing cash for the difference (paper currencies and coins) is outputted.

The cash depositing/dispensing machine 13 has a paper currency depositing/dispensing machine 30 and a coin depositing/dispensing machine 31 next to each other provided on the left and right sides when seen from the operator (hereinafter, referred to as simply "on the left and right sides"). The paper currency depositing/dispensing machine 30 and the coin depositing/dispensing machine 31 receive instructions from the POS register 12 to carry out cash depositing/dispensing processes.

The paper currency depositing/dispensing machine 30 has: a cash entry port 33; a cash dispensing/rejecting port 34; and a paper currency depositing/dispensing mechanism section 35 and a paper currency depositing/dispensing control section 36 shown in FIG. 2. The cash entry port 33 is provided on the front face upper section of the paper currency depositing/dispensing machine 30 and receives a paper currency deposit. The cash dispensing/rejecting port 34 is provided on the front face of the paper currency depositing/dispensing machine 30, which is on the lower side of the cash entry port 33. The paper currency depositing/dispensing mechanism section 35 carries out essentially a cash depositing process for paper currency put into the cash entry port 33, and a cash dispensing process for dispensing internally stored paper currency to the cash dispensing/rejecting port 34. The paper currency depositing/dispensing control section 36 controls the paper currency depositing/dispensing mechanism section 35.

The coin depositing/dispensing machine 31 has: a cash entry port 38; a cash dispensing port 39; and a coin depositing/dispensing mechanism section 40 and a coin depositing/dispensing control section 41 shown in FIG. 2. The cash entry port 38 is provided on the upper section of the coin depositing/dispensing machine 31 and receives a coin deposit. The cash dispensing port 39 is provided on the front face lower section of the coin depositing/dispensing machine 31, and dispenses coins for cash dispensing. The coin depositing/dispensing mechanism section 40 carries out essentially a cash depositing process for coins put into the cash entry port 38, and a cash dispensing process for dispensing internally stored coins to the cash dispensing port 39. The coin depositing/dispensing control section 41 controls the coin depositing/dispensing mechanism section 40.

The coin bar storage 14 of the first embodiment has a casing 50 and a coin bar tray 51. On the top face of the casing 50, there is provided the cash depositing/dispensing machine 13. The coin bar tray 51 can be drawn out towards the operator side and can be stored into the casing 50.

Coin bars of respective coin types to be stored in the coin bar tray 51 are described. As shown in the table of FIG. 3, the types of coin bars that may be currently handled in Japan are: one-yen coin bar; five-yen coin bar, ten-yen coin bar; fifty-yen coin bar, one-hundred-yen coin bar; first five-hundred-yen coin bar; and second five-hundred-yen coin bar. A one-yen coin bar is a packed coin bar in which fifty one-yen aluminum coins are stacked. A five-yen coin bar is a packed coin bar in which fifty five-yen brass coins are stacked. A ten-yen coin bar is a packed coin bar in which fifty ten-yen bronze coins are stacked. A fifty-yen coin bar is a packed coin bar in which fifty fifty-yen cupronickel coins are stacked. A one-hundred-yen coin bar is a packed coin bar in which fifty one-hundred-yen cupronickel coins are stacked. A first five-hundred-yen coin bar is a packed coin bar in which fifty five-hundred-yen cupronickel coins are stacked. A second five-hundred-yen coin bar is a packed coin bar in which fifty five-hundred-yen nickel brass coins are stacked.

Comparing materials of these coins, the fifty-yen coin, the one-hundred-yen coin, and the first five-hundred-yen coin share a common component and their electrical conductivities are the same. On the other hand, among the one-yen coin, the five-yen coin, the ten-yen coin, and the second five-hundred-yen coin, their components differ from each other and their electrical conductivities also differ from each other. Comparing diameters of these coins, the diameter of the first five-hundred-yen coin is the same as that of the second five-hundred-yen coin. On the other hand, the diameters of the one-yen coin, the five-yen coin, the ten-yen coin, the fifty-yen coin, and the one-hundred-yen coin are different from each other. Comparing weights of the coin bars of these coins, although the difference between the weight of a coin bar of the first five-hundred-yen coins and the weight of a coin bar of the second five-hundred-yen coins is small, the weights of these coin bars are different from each other. Comparing lengths of these coin bars, the lengths of a one-yen coin bar, a five-yen coin bar, and a ten-yen coin bar are equal to each other and are shorter than those of the coins of other types. A one-hundred-yen coin bar is slightly longer than a one-yen coin bar, a five-yen coin bar, and a ten-yen coin bar. A fifty-yen coin bar is longer than a one-hundred-yen coin bar. The length of a first five-hundred-yen coin bar is equal to that of a second five-hundred-yen coin bar, and is longer than that of a fifty-yen coin bar.

As shown in FIG. 1, the casing 50 is of a substantially rectangular solid box shape with a short height. On the user side front face of this casing 50, there is formed an opening section 52.

Figure 4:
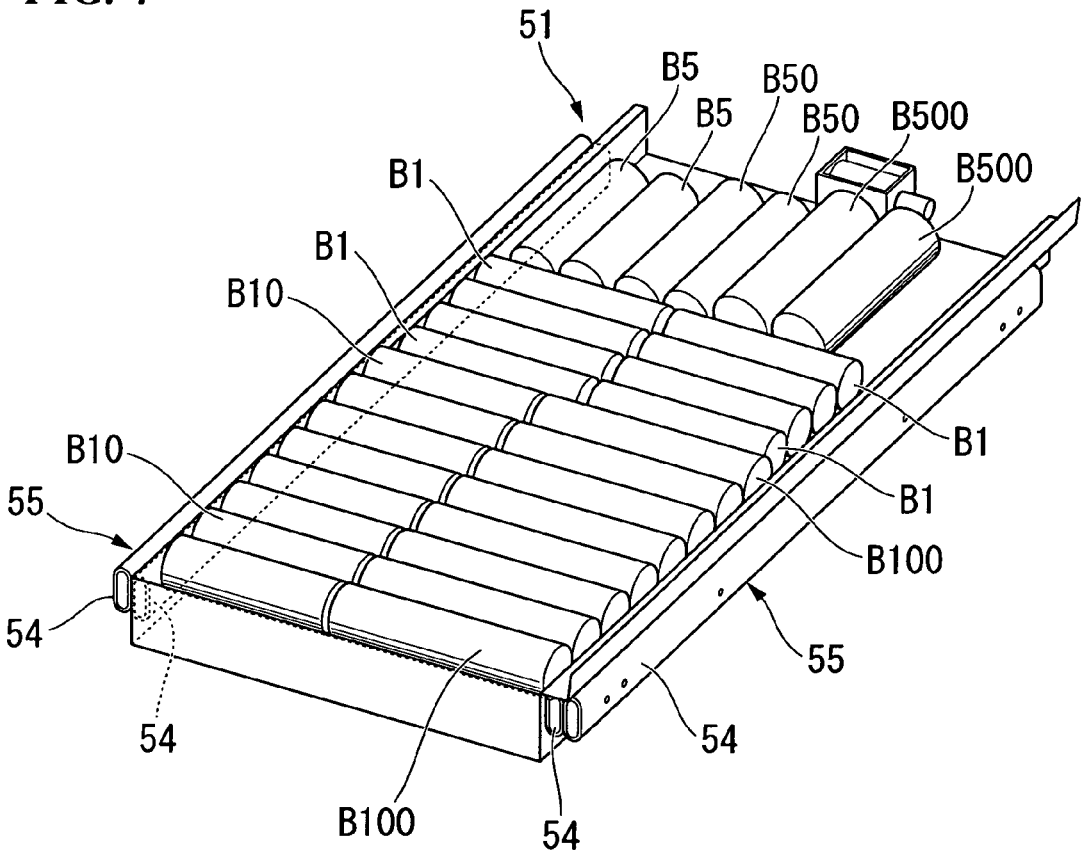
FIG. 4 is a perspective view showing a state of accommodating coin bars on a coin bar tray of the coin bar storage of the first embodiment of the present invention.

As shown in FIG. 4, two slide rails 55 have a pair of rails 54, respectively. These two pairs of rails 54 are respectively arranged on the outer sides of the coin bar tray 51 so as to extend along the front-rear direction. The pair of rails 54 mutually slides on each other. One of the rails 54 of the slide rail 55 is fixed on the coin bar tray 51, and the other rail 54 is fixed on the inner side face (not shown in the drawing) of the casing 50, thereby, the slide rails 55 being slidably supported on the casing 50. In the casing 50, there are provided a closed position switch (storage detection section) 58 and a draw-out switch (storage detection section) 59 shown in FIG. 2. The closed position switch 58 is turned ON by the coin bar tray 51 in a state where the coin bar tray 51 is stored inside the casing 50. On the other hand, the closed position switch 58 is turned OFF by the coin bar tray 51 when the coin bar tray 51 is positioned in any other positions. The draw-out switch 59 is turned ON by the coin bar tray 51 when the coin bar tray 51 is positioned in a predetermined position at which the coin bar tray 51 is drawn out from the casing 50. On the other hand, the draw-out switch 59 is turned OFF by the coin bar tray 51 when the coin bar tray 51 is positioned in any other positions. These closed position switch 58 and draw-out switch 59 are connected to a coin bar storage control section (a set coin type presence confirmation section, a confirmation section, a management section, a storage detection section, and a power supply monitoring section) 60. In the case where the draw-out switch 59 is switched from OFF to ON and then the closed position switch 58 is turned ON, this coin bar storage control section 60 detects a switching from an open state where the coin bar tray 51 is drawn out from the casing 50 into a closed state where the coin bar tray 51 is stored inside the casing 50. That is to say, the coin bar storage control section 60 detects an open-closed switching of the coin bar tray 51. In the case where the draw-out switch 59 is turned ON within a predetermined period of time since the closed position switch 58 is turned from ON to OFF, the coin bar storage control section 60 detects a switching from a closed state into an open state of the coin bar tray 51 with respect to the casing 50. That is to say, the coin bar storage control section 60 detects an open-closed switching of the coin bar tray 51.

Figure 5:
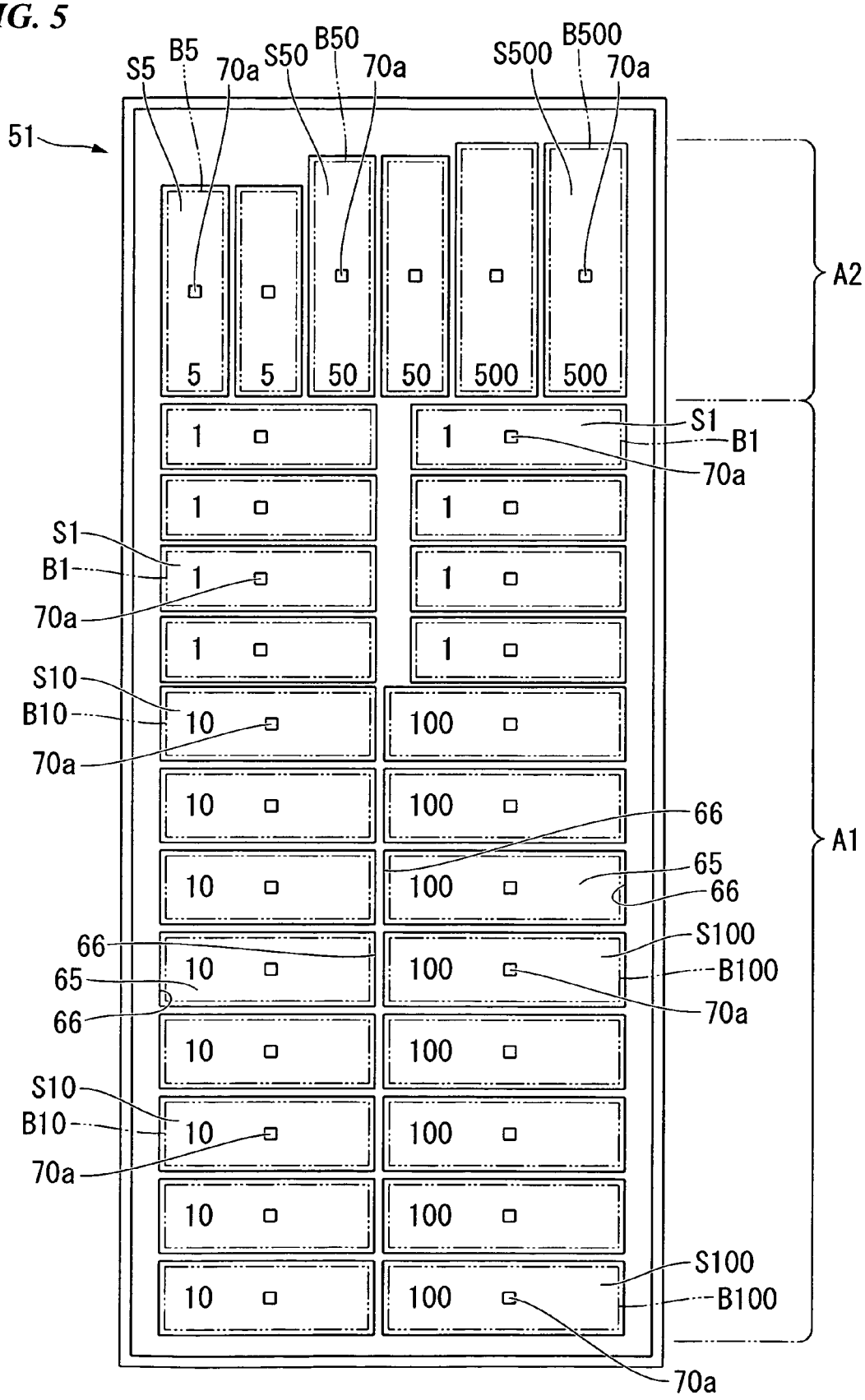
FIG. 5 is a plan view showing the coin bar tray of the coin bar storage of the first embodiment of the present invention.

The coin bar tray 51 is partitioned into a first range A1 and a second range A2 as shown in FIG. 5. The first range A1 is on the operator side, that is, the draw-out direction front side. The second range A2 is on the draw-out direction rear side of the first range A1. In the first range A1, there are provided a plurality of set sections S100, a plurality of set sections S10, and a plurality of set sections S1. The coin type of a coin bar to be set in the set section S100 is pre-set to a one-hundred-yen coin bar B100. The coin type of a coin bar to be set in the set section S10 is pre-set to a ten-yen coin bar B10. The coin type of a coin bar to be set in the set section S1 is pre-set to a one-yen coin bar B1. In the second range A2, there are provided a plurality of set sections S500, a plurality of set sections S50, and a plurality of set sections S5. The coin type of a coin bar to be set in the set section S500 is pre-set to a five-hundred-yen coin bar B500. The coin type of a coin bar to be set in the set section S50 is pre-set to a fifty-yen coin bar B50. The coin type of a coin bar to be set in the set section S5 is pre-set to a five-yen coin bar B5. That is to say, the coin bar tray 51 has the set sections S1, S5, S10, S50, S100, and S500 for separate coin types to which the coin types of coin bars to be set are pre-set. The numbers of the one-yen coins, the ten-yen coins, and the one-hundred-yen coins to be used as change cash are likely to be greater than those of the five-yen coins, the fifty-yen coins, and the five-hundred-yen coins, and the numbers of the one-yen coins, the ten-yen coins, and the one-hundred-yen coins to be prepared are four times those of the five-yen coins, the fifty-yen coins, and the five-hundred-yen coins for example. Therefore, for ease of use, the one-yen coin bars B1, the ten-yen coin bars B10, and the one-hundred-yen coin bars B100, which are frequently used, are stored in the first range A1 that is on the draw-out direction front side of the coin bar tray 51 from which these coin bars can be easily taken out. On the other hand, the five-yen coin bars B5, the fifty-yen coin bars B50, and the five-hundred-yen coin bars B500, which are less frequently used, are stored in the second range A2 on the draw-out direction rear side of the coin bar tray 51.

More specifically, in FIG. 5, on the left side of the coin bar tray 51 in the draw-out direction front section of the first range A1, there is provided a plurality of the set sections for any one of the coin types (hereinafter referred to as "a first coin type") of; the one-hundred-yen coin bars B100, the ten-yen coin bars B10, and the one-yen coin bars B1. Specifically, there is provided a plurality of the set sections S10 for the ten-yen coin bars B10. In FIG. 5, on the other side, that is, the right side of the coin bar tray 51 in the draw-out direction front section of the first range A1, there is provided a plurality of set sections for any one of the coin types (hereinafter referred to as "a second coin type") of; the one-hundred-yen coin bars B100, the ten-yen coin bars B10, and the one-yen coin bars B1. Specifically, there is provided a plurality of the set sections S100 for the one-hundred-yen coin bars B100. In the draw-out direction rear section of the first range A1, there is provided a plurality of set sections for any one of the coin types (hereinafter referred to as "a third coin type") of; the one-hundred-yen coin bars B100, the ten-yen coin bars B10, and the one-yen coin bars B1. Specifically, there is provided a plurality of the set sections S1 for the one-yen coin bars B1.

In the set sections S10 for the ten-yen coin bars B10 in a plurality of locations, specifically in eight locations, there will be set the ten-yen coin bars B10 with an orientation in which their axes are positioned along the left-right direction in FIG. 5. The ten-yen coin bars B10 are provided in a row in the draw-out direction with the positions of the ends of the respective coin bars aligned.

In the set sections S100 for the one-hundred-yen coin bars B100 in a plurality of locations, specifically in eight locations, there will be set the ten-yen coin bars B100 with an orientation in which their axes are positioned along the left-right direction in FIG. 5. The one-hundred-yen coin bars B100 are provided in a row in the draw-out direction with the positions of the ends of the respective coin bars aligned. In addition, among the set sections S100 in eight locations for the one-hundred-yen coin bars B100 and the set sections S10 in eight locations for the ten-yen coin bars B10, the set sections S100 and S10 on the left and right sides, with the same arrangement orders from the draw-out direction front side, are in positions mutually aligned in the draw-out direction (top-bottom direction in FIG. 5). As a result, the entire set sections S100 in eight locations for the one-hundred-yen coin bars B100 and the entire set sections S10 in eight locations for the ten-yen coin bars B10 are in positions aligned in the draw-out direction.

In the set sections S1 in a plurality of locations, specifically eight locations, for the one-yen coin bars B1, there will be set the one-yen coin bars B1 with an orientation in which their axes are along the left-right direction in FIG. 5, and they are divided into four locations on each of the left side and the right side. In other words, the set sections S1 in four locations on the left side are provided in a row with their ends respectively aligned and positioned along the draw-out direction. In addition, the positions of the end sections of the set sections S1 in the four locations on the left side substantially match with the positions of the end sections of the set sections S10 in the eight locations for the ten-yen coin bars B10. The set sections S1 in the four locations on the right side are provided in a row while their end sections are respectively aligned and positioned along the draw-out direction. In addition, the positions of the end sections of the set sections S1 in the four locations on the right side substantially match with the positions of the end sections of the set sections S100 in the eight locations for the one-hundred-yen coin bars B100. In addition, among the set sections S1 in four locations on the left side and the set sections S1 in four locations on the right side, the set sections S1 on the left and right sides with the same arrangement orders from the draw-out direction front side, are in positions mutually aligned in the draw-out direction (top-bottom direction in FIG. 5). As a result, the entire set sections S1 in the four locations on the left side and the entire set sections S1 in the four locations on the right side are positioned so as to match with each other in the draw-out direction.

As shown in FIG. 3, among the one-yen coin bars B1, the ten-yen coin bars B10, and the one-hundred-yen coin bars B100 to be stored in the first range A1, the difference in diameters is smallest between the ten-yen coin bars B10 and the one-hundred-yen coin bars B100. Accordingly, there is a small difference between the draw-out direction length of the entire set sections S10 in the eight locations for the ten-yen coin bars B10 and the draw-out direction length of the entire set sections S100 in the eight locations for the one-hundred-yen coins B100. Therefore, by arranging these coin bars on the left and right sides, effective use of space can be realized.

In the second range A2, there are separately provided, for separate coin types, a plurality of the set sections S500 for the five-hundred-yen coin bars B500, a plurality of the set sections S50 for the fifty-yen coin bars B50, and a plurality of the set sections S5 for the five-yen coin bars B5.

In the set sections S5 for the five-yen coin bars B5 in a plurality of locations, specifically in two locations, there will be set the five-yen coin bars B5 with an orientation in which their axes are along the draw-out direction. The respective set sections S5 are provided next to each other on the left and right on the most left side with their positions in the draw-out direction aligned.

In the set sections S50 for the fifty-yen coin bars B50 in a plurality of locations, specifically in two locations, there will be set the fifty-yen coin bars B50 with an orientation in which their axes are along the draw-out direction. The respective set sections S50 are provided next to each other on the left and right in the intermediate position in the left-right direction with their positions in the draw-out direction aligned.

In the set sections S500 for the five-hundred-yen coin bars B500 in a plurality of locations, specifically in two locations, there will be set the five-hundred-yen coin bars B500 with an orientation in which their axes are along the draw-out direction. The respective set sections S500 are provided next to each other on the left and right on the most right side with their positions in the draw-out direction aligned. The positions, on the draw-out direction front side (top-bottom direction lower side in FIG. 5), of the end sections of the set sections S5 in the two locations for the five-yen coin bars B5, the set sections S50 in the two locations for the fifty-yen coin bars B50, and the set sections S500 in the two locations for the five-hundred-yen coin bars B500, are all substantially aligned.

Figure 6A:
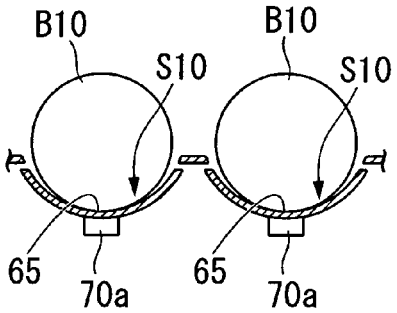
FIG. 6A is a sectional side view showing set sections of the coin bar storage of the first embodiment of the present invention.
Figure 6B:
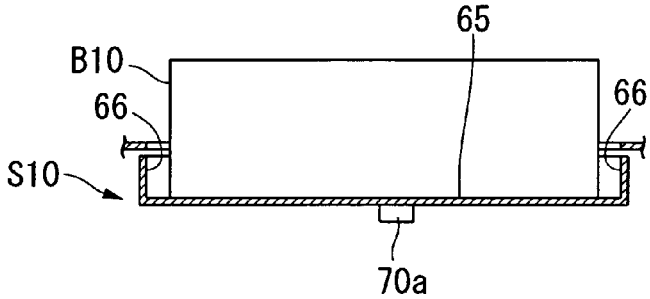
FIG. 6B is a sectional front view showing the set section of the coin bar storage of the first embodiment of the present invention.

The above respective set sections S1, S5, S10, S50, S100, and S500 are provided in a concave shape that is concaved downward, so as to be able to individually elevate as seen in an example of the set section S10 in FIG. 6A and FIG. 6B. The set section has a bottom face 65, a pair of end faces 66, and an opening section. The bottom face 65 is of a large-diametered cylindrical shape, the diameter of which is greater than that of a coin bar of the set coin type to be set. The pair of end faces 66 is formed on both sides in the axial direction of this bottom face 65. The opening section is of a rectangular shape when seen from above. On the respective set sections S1, S5, S10, S50, S100, and S500, there are displayed the pre-set coin types of the coin bars to be set, and these are color coded for each of the coin types. The radius of the bottom face 65 of each of the set sections S1, S5, S10, S50, S100, and S500, and the width of each of these set sections in the direction orthogonal to the end face 66 are respectively set according to the size of the coin bars to be set. However, they may be made the same for all coin types.

For example, the respective set sections S10 for the ten-yen coin bars B10 have digits "10" displayed on their bottom faces 65, and they are entirely painted with a predetermined first color. The respective set sections S100 for the one-hundred-yen coin bars B100 have digits "100" displayed on their bottom faces 65, and they are entirely painted with a predetermined second color. The respective set sections S1 for the one-yen coin bars B1 have digit "1" displayed on their bottom faces 65, and they are entirely painted with a predetermined third color. The respective set sections S5 for the five-yen coin bars B5 have digit "5" displayed on their bottom faces 65, and they are entirely painted with a predetermined fourth color.

The respective set sections S50 for the fifty-yen coin bars B50 have digits "50" displayed on their bottom faces 65, and they are entirely painted with a predetermined fifth color. The respective set sections S500 for the five-hundred-yen coin bars B500 have digits "500" displayed on their bottom faces 65, and they are entirely painted with a predetermined sixth color.

In the set section S1 for the one-yen coin bars B1, the set section S5 for the five-yen coin bars B5, and the set section S10 for the ten-yen coin bars B10, for which the length of the coin bars to be set is short, the distance between both of the end faces 66 is set so that a coin bar of a length longer than the coin bar to be set cannot enter therein. That is to say, the lengths of these set sections S1, S5 and S10 are set so that the fifty-yen coin bar B50, the one-hundred-yen coin bar B100, and the five-hundred-yen coin bar B500 cannot enter therein.

In all of the set sections S1, S5, S10, S50, S100, and S500 of the coin bar tray 51, there are respectively provided weight sensors (set coin type presence confirmation sections) 70*a* for detecting the weight of set coin bars.

By making use of a multiplexor circuit or the like, output from all of the weight sensors 70*a* can be scanned in a time division manner to be identification-processed. A result of the identification process is transmitted to the coin bar storage control section 60. The coin types of coin bars; B1, B5, B10, B50, B100, and B500 to be set are pre-set to all of the set sections S1, S5, S10, S50, S100, and S500. Accordingly, the coin bar storage control section 60 determines whether or not the weights of the set coin bars respectively match with reference weights of the coin bars B1, B5, B10, B50, B100, and B500 of the set coin types within an allowable range, based on detection results detected by the weight sensors 70*a* provided with the set sections S1, S5, S10, S50, S100, and S500. Based on this determination result, the coin bar storage control section 60 confirms the presence or absence of the pre-set set coin types.

That is to say, if the error margin between the weight detected by the weight sensor 70*a* and the reference weight of a coin bar of the set coin type falls within the allowable range, then it is determined that the coin bar of the set coin type is present. On the other hand, if the error margin between the weight detected by the weight sensor 70*a* and the reference weight of a coin bar of the set coin type does not fall within the allowable range, then it is determined that the coin bar of the set coin type is absent (that no coin bar is present, or a coin bar other than the coin bar of the set coin type (including an other object) is present).

More specifically, if the error margin between the weight detected by the weight sensor 70*a* in the set section S10 for the ten-yen coin bars B10 and the reference weight for the ten-yen coin bar B10 falls within the allowable range, then it is determined that a ten-yen coin bar is present. On the other hand, if this error margin does not fall within the allowable range, then it is determined that no ten-yen coin bar is present. If the error margin between the weight detected by the weight sensor 70*a* in the set section S100 for the one-hundred-yen coin bar B100 and the reference weight of the one-hundred-yen coin bar B100 falls within the allowable range, then it is determined that a one-hundred-yen coin bar is present. On the other hand, if this error margin does not fall within the allowable range, then it is determined that no one-hundred-yen coin bar is present. The coin bar storage control section 60 detects a present amount of coin bars within the coin bar storage 14 based on the detection results of all of the weight sensors 70*a*.

As shown in FIG. 2, the coin bar storage control section 60 is communicably connected to the POS register control section 20. To this POS register control section 20, there are communicably connected the paper currency depositing/dispensing control section 36 and the coin depositing/dispensing control section 41. The POS register control section 20 receives electric power supply from an external power supply, and supplies electric power respectively to the paper currency depositing/dispensing control section 36, the coin depositing/dispensing control section 41, and the coin bar storage control section 60. The POS register control section 20 is communicably connected to a system management device 71 that performs overall control of all of the register apparatuses 11.

The coin bar storage control section 60 detects a switching from an open state where the coin bar tray 51 is drawn out from the casing 50 into a closed state where the coin bar tray 51 is stored inside the casing 50. That is to say, it detects an open-closed switching of the coin bar tray 51 when the draw-out switch 59 is switched from OFF to ON and then the closed position switch 58 is turned ON. Having detected this open-closed switching, the coin bar storage control section 60 detects a present amount of coin bars within the coin bar storage 14 based on detection results of all of the weight sensors 70*a*. This is because, when the coin bar tray 51 is drawn out from the casing 50, the present amount of the coin bars B1, B5, B10, B50, B100, and B500 in the coin bar tray 51 is highly likely to change due to the reason described below. It is highly likely that the coin bars stored in any of the set sections S1, S5, S10, S50, S100, and S500 may be taken out for reloading the coin depositing/dispensing machine 31 or that coin bars may be additionally stored in any one of the set sections S1, S5, S10, S50, S100, and S500. Therefore, if the coin bar tray 51 is stored inside the casing 50 after it was drawn out, a present amount of coin bars is detected at this point. The coin types of coin bars to be set are pre-set to the respective set sections S1, S5, S10, S50, S100, and S500. Accordingly, the coin bar storage control section 60 is capable of detecting a present amount of coin bars within the coin bar storage 14 based on the number of the weight sensors 70*a* that have detected the presence of coin bars of the set coin types in the respective set sections S1, S5, S10, S50, S100, and S500. At this time, the detection result from the weight sensor 70*a* that has detected an absence of coin bars of the set coin type is excluded from the detection of the present amount of the coin bars.

When an OFF-ON switching from OFF to ON of electric power externally supplied via the POS register control section 20 is detected, the coin bar storage control section 60 detects a present amount of coin bars within the coin bar storage 14 based on the detection results from all of the weight sensors 70*a*. That is to say, if there occurs an unstable situation for managing the coin bars such as a power failure or an interruption, where the external power supply is turned OFF and coin bar management is difficult to perform, then the present amount of coin bars within the coin bar storage 14 is immediately detected after this in a manner similar to that mentioned above at the point when the power supply has been restored.

The coin bar storage control section 60 transmits the detected coin bar amount to the POS register control section 20. Having received the transmission, the POS register control section 20 updates and stores this coin bar amount within the coin bar storage 14, and outputs the coin bar amount to the system management device 71. If there is an appropriate input on the operation section 23, the POS register control section 20 displays a present amount of coin bars at this point on the display section 24. The system management device 71 calculates and displays the number of coin bars for each of the coin types to be prepared for the next coin bar reloading, based on information of the present amount of coin bars transmitted from each of the register devices 11. The operator who carries out coin bar reloading prepares coin bars based on this display. The system management device 71 monitors whether or not there is any coin type of coin bars that have all been taken out in each of the register devices 11. In the case where there is a register device 11 that requires a reload of coin bars of a coin type that have all been taken out, the system management device 71 triggers an alarm and prompts a reload of the required coin type for that register device 11.

According to the first embodiment described above, the coin bar tray 51 has the set sections S1, S5, S10, S50, S100, and S500 of different coin types having pre-set coin types of coin bars to be set. In all of these set sections S1, S5, S10, S50, S100, and S500, there are provided the weight sensors 70*a* that detect the presence of coin bars. The coin bar storage control section 60 detects a present amount of coin bars by having the respective weight sensors 70*a* detect the presence of coin bars in the corresponding set sections. As described above, since there are provided the weight sensors 70*a* that detect the presence of coin bars in all of the set sections S1, S5, S10, S50, S100, and S500, a present amount of coin bars can be detected at an arbitrary timing.

The coin types of coin bars to be set are pre-set to the set sections S1, S5, S10, S50, S100, and S500. Therefore, the weight sensor 70*a* and the coin bar storage control section 60 only need to be able to detect whether the coin bar of the set coin type is set or in other states (no coin bar is present, a coin bar of a different coin type is set, an object other than a coin bar, or an abnormal coin bar is set). Therefore, the configuration and control can be simplified and a cost reduction can be realized. Furthermore, it is detected whether a coin bar of the set coin type is in a state of having been set or in other states. As a result, in a state where coin bars of incorrect coin types other than the set coin types are set in the set sections S1, S5, S10, S50, S100, and S500, a detection of an incorrect present amount of coin bars can be prevented.

When an open-closed switching of the coin bar tray 51 from a state of having been drawn out from the casing 50 into a state of being stored in the casing 50 is detected based on the detection results of the closed position switch 58 and the draw-out switch 59, the coin bar storage control section 60 detects a present amount of coin bars. Therefore, a present amount of coin bars can be automatically detected when the coin bar tray 51 is stored after it has been drawn out where the number of coin bars on the coin bar tray 51 changes. That is to say, an unnecessary detection of a coin bar amount at the time where the present amount of coin bars does not change would not be carried out, and the present amount of coin bars can be detected efficiently.

The coin bar storage control section 60 detects the present amount of coin bars when an OFF-ON switching in the external power supply from OFF to ON is detected. Accordingly, even if there occurs an unstable situation for managing the coin bars such as a power failure or an interruption, where the external power supply is turned OFF and coin bar management is difficult to perform, then the present amount of coin bars can be immediately detected after this at the point when the power supply has been restored. Therefore, even if there occurs a management problem in a situation where it is difficult to perform coin bar management, the present amount can be immediately detected and the problem can be thereby immediately handled.

A coin bar which is configured by stacking and packing a prescribed number of coins has a weight that sufficiently enables identification of coin types. Therefore, each of the weight sensors 70*a* set in the set sections S1, S5, S10, S50, S100, and S500 detects the weight of a coin bar, and based on whether or not this detected weight of the coin bar matches with the reference weight of the coin bar of the set coin type within the allowable range, the coin bar storage control section 60 can confirm the presence of the coin bar of the set coin type. Therefore, with such a simple configuration, the presence of the coin bar of the set coin type can be reliably detected.

As described above, the set sections S1, S5, S10, S50, S100, and S500 may have fewer coin types of coin bars that need to be compared as described below. That is to say, by making use of a length difference between coin bars, setting of a coin bar that is longer than that of the coin bar of the set coin type becomes impossible. By making use of an outer diameter difference between coin bars, setting of a coin bar of different coin types other than the coin bar of the set coin type becomes impossible. Or, even if setting of such a coin bar is possible, it is made impossible to be detected by the weight sensor 70*a*. Thereby, the precision of weight detection of the weight sensor 70*a* can be reduced, and a low cost weight sensor 70*a* can be used.

Next, a coin bar storage of a second embodiment of the present invention is described with reference to FIG. 7A and FIG. 7B, mainly focusing on the points different from those in the first embodiment. Components that are the same as those in the first embodiment are denoted by the same reference symbols, and descriptions thereof are omitted.

In a coin bar storage 14 of the second embodiment, for detecting the presence of coin bars of the pre-set set coin types in the respective set sections S1, S5, S10, S50, S100, and S500, there are provided distance sensors (set coin type presence confirmation sections) 70*b* to replace the weight sensors 70*a* in the first embodiment.

Figure 7A:
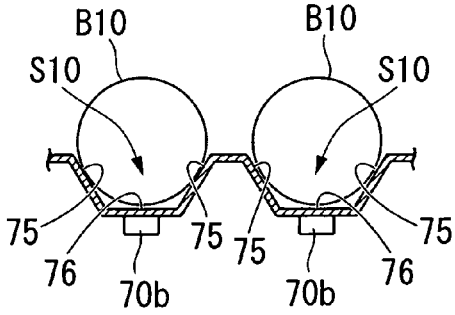
FIG. 7A is a sectional side view showing set sections of a coin bar storage of a second embodiment of the present invention.
Figure 7B:
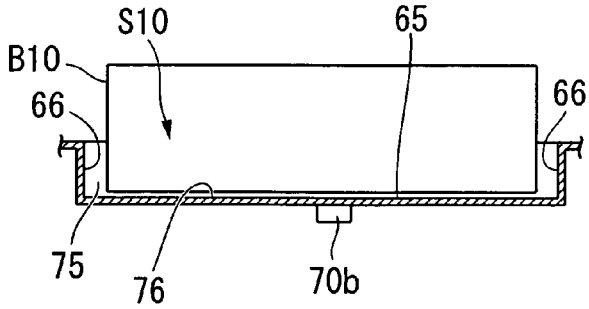
FIG. 7B is a sectional front view showing the set section of the coin bar storage of the second embodiment of the present invention.

Therefore, first, all of the set sections S1, S5, S10, S50, S100, and S500 of the coin bar tray 51 are configured so that the set height of a coin bar (the shortest distance from a bottom face 76 to the outer periphery of a coin bar shown in FIG. 7A and FIG. 7B) becomes different depending on the outer diameter of the coin bar to be set. Specifically, the respective set sections S1, S5, S10, S50, S100, and S500 are provided in a concave shape concaved downward, the sectional face of which is of an isosceles trapezoid shape, as seen in an example of the set section S10 in FIG. 7A and FIG. 7B. The set section S10 has a pair of supporting faces 75 and the bottom face 76. The pair of supporting faces 75 is mirror-symmetric about the vertical plane, and the distance from each other becomes narrower downward. The bottom face 76 is a horizontal face that connects the lower end portions of the supporting faces 75. The shortest width between the pair of supporting faces 75 is narrower than the outer diameter of a coin bar of the set coin type to be set. The shortest distance between the pair of supporting faces 75 of each of the set sections S1, S5, S10, S50, S100, and S500 is respectively set according to the coin bar to be set. However, it may be a same common width that enables support for coin bars of all coin types.

Thus, in all of the set sections S1, S5, S10, S50, S100, and S500, the shortest distance between the outer periphery of the coin bar to be set and the bottom face 76 of the set section, that is, the set height is different, depending on the outer diameter of the coin bar respectively to be set in the set sections. The noncontact type distance sensor 70*b* for detecting this set height is provided on the bottom face 76. This distance sensor 70*b* is an optical reflection type sensor for example.

By making use of a multiplexor circuit or the like, output from all of the distance sensors 70*b* can be scanned in a time division manner to be identification-processed. The identification processing result is transmitted to the coin bar storage control section 60. The coin types of coin bars; B1, B5, B10, B50, B100, and B500 to be set are pre-set to all of the set sections S1, S5, S10, S50, S100, and S500. Therefore, the coin bar storage control section 60 is able to confirm the presence of the coin bars of the set coin types, based on whether or not the set heights detected by the distance sensors 70*b* provided in all of the set sections S1, S5, S10, S50, S100, and S500 match with reference set heights of the coin bars B1, B5, B10, B50, B100, and B500 of the set coin types within the allowable range. That is to say, in the set sections S1, S5, S10, S50, S100, and S500, if the coin bar of the set coin type is set, then the set height detected by the distance sensor 70*b* is equal to the reference set height. If a coin bar of a diameter smaller than that of the coin bar of the set coin type is set, then the set height detected by the distance sensor 70*b* is lower than that in the case of detecting the coin bar of the set coin type. If a coin bar of a diameter greater than that of the coin bar of the set coin type is set, then the set height detected by the distance sensor 70*b* is higher than that in the case of detecting the coin bar of the set coin type.

If the error margin between the set height detected by the distance sensor 70*b* and the reference set height of the coin bar of the set coin type falls within the allowable range, then it is determined that a coin bar of the set coin type is present. If the error margin between the set height detected by the distance sensor 70*b* and the reference set height of the coin bar of the set coin type does not fall within the allowable range, then it is determined that the coin bar of the set coin type is absent (that no coin bar is present, or a coin bar other than the coin bar of the set coin type (including an other object) is present).

More specifically, this is determined for example as described below. If the error margin between the detected set height detected by the distance sensor 70*b* of the set section S10 for the ten-yen coin bar B10 and the reference set height of the ten-yen coin bar B10 falls within the allowable range, then it is determined that the ten-yen coin bar B10 is present. On the other hand, if this error margin does not fall within the allowable range, then it is determined that no ten-yen coin bar B10 is present. If the error margin between the detected set height detected by the distance sensor 70*b* of the set section S100 for the one-hundred-yen coin bar B100 and the reference set height of the one-hundred-yen coin bar B100 falls within the allowable range, then it is determined that the one-hundred-yen coin bar B100 is present. On the other hand, if this error margin does not fall within the allowable range, then it is determined that no one-hundred-yen coin bar is present. The coin bar storage control section 60 detects a present amount of coin bars within the coin bar storage 14 in a manner similar to that of the first embodiment, based on detection results of all of the height sensors 70*b*.

The coin bars B1, B5, B10, B50, B100, and B500 formed with packed coins of prescribed outer diameters respectively have different outer diameters that sufficiently enable identification of the coin types. Therefore, according to the second embodiment described above, the presence of coin bars of the set coin types is detected as described below. That is to say, making use of differences in the outer diameters of the coin bars, the set heights in the set sections S1, S5, S10, S50, S100, and S500 are made different depending on the coin types of set coin bars. The set heights of the coin bars in the set sections S1, S5, S10, S50, S100, and S500 are detected by the distance sensors 70*b*. The presence of the coin bar of the set coin type is confirmed based on whether or not this detection result matches with the reference set height of the coin bar of the set coin type within the allowable range. Therefore, with such a simple configuration, the presence of the coin bar of the set coin type can be reliably detected.

The set sections S1, S5, S10, S50, S100, and S500 support the outer peripheries of the coin bars on the pair of supporting faces 75 of a shape where the gap between the supporting faces 75 narrows downward. Thereby, the set heights of coin bars are made different depending on the outer diameters of coin bars. As described above, with such a simple configuration, the set heights of the coin bar can be made different depending on the size of the outer diameters of set coin bars.

The set height that changes according to the outer diameter is detected by the distance sensor 70*b*. Therefore, even a coin bar (including an other object) other than the coin bar of the set coin type which has the weight same as that of the coin bar of the set coin type and the outer diameter different from that of the coin bar of the set coin type, which cannot be detected in the first embodiment that uses the weight sensor, can be determined not a coin bar of the set coin type.

Figure 8A:
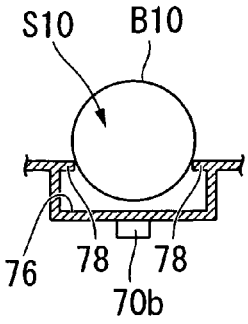
FIG. 8A is a sectional side view seen from one side showing a modified example of the set section of the coin bar storage of the second embodiment of the present invention.
Figure 8B:
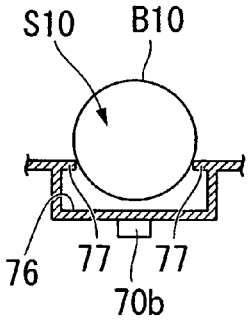
FIG. 8B is a sectional side view seen from the other side showing the modified example of the set section of the coin bar storage of the second embodiment of the present invention.
Figure 8C:
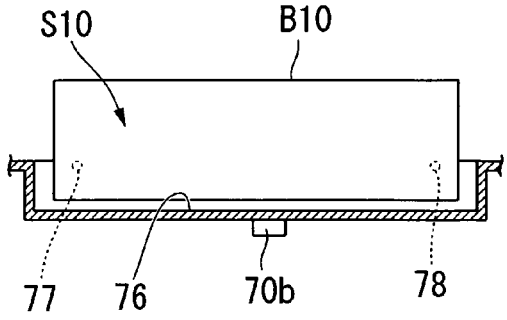
FIG. 8C is a sectional front view showing the modified example of the set section of the coin bar storage of the second embodiment of the present invention.

The set sections S1, S5, S10, S50, S100, and S500 as shown in FIG. 8A to FIG. 8C, have a pair of supporting points 77 and a pair of supporting points 78 respectively on both sides in the axial direction of a coin bar instead of the pair of supporting faces 75. The pair of supporting points 77 and the pair of supporting points 78 are positioned at a same height having a gap therebetween narrower than the outer diameter of the coin bar of the smallest diameter, and they are arranged so that their positions in the axial direction are aligned. The set height of the coin bar may be made different according to the outer diameter of the coin bar to be set by supporting the coin bar with these supporting points. Also with such a simple configuration, the set height of the coin bar can be made different depending on the size of the outer diameters of coin bars to be set.

Next, a coin bar storage of a third embodiment of the present invention is described with reference to FIG. 9A and FIG. 9B, mainly focusing on the points different from those in the second embodiment. Components that are the same as those in the second embodiment are denoted by the same reference symbols, and descriptions thereof are omitted.

Figure 9A:
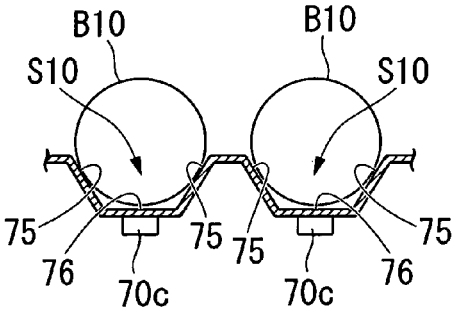
FIG. 9A is a sectional side view showing set sections of a coin bar storage of a third embodiment of the present invention.
Figure 9B:
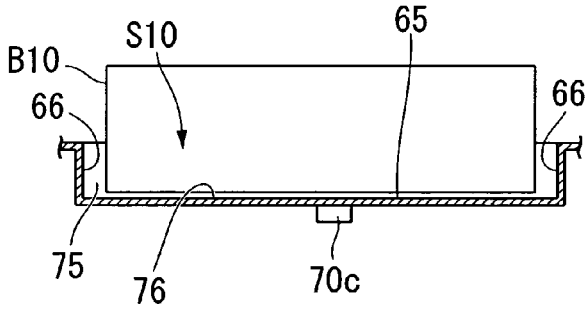
FIG. 9B is a sectional front view showing the set section of the coin bar storage of the third embodiment of the present invention.

In a coin bar storage 14 of the third embodiment, as shown with an example of the set section S10 in FIG. 9A and FIG. 9B, there are provided magnetic sensors (set coin type presence confirmation sections) 70*c* that replace the distance sensors in the second embodiment, for detecting the presence of coin bars of the pre-set set coin types in the respective set sections S1, S5, S10, S50, S100, and S500.

That is to say, as with the second embodiment, the set sections S1, S5, S10, S50, S100, and S500 respectively have a pair of supporting faces 75 and a bottom face 76. The pair of supporting faces 75 is of a shape with a gap therebetween that becomes narrower downward. The bottom face 76 is a horizontal face that connects the lower end portions of the supporting faces 75. The set sections S1, S5, S10, S50, S100, and S500 are configured so that the distances from the bottom faces 76 to the outer peripheries of a coin, that is, the set heights are different depending on the outer diameter of the coin bar to be set. On the bottom face 76, there is provided a noncontact type magnetic sensor 70*c* that detects magnetic charge (magnetic data) corresponding to this set height.

By making use of a multiplexor circuit or the like, the output from all of the magnetic sensors 70*c* can be scanned in a time division manner to be identification-processed. This identification processing result is transmitted to the coin bar storage control section 60. The coin types of coin bars to be set are pre-set to all of the set sections S1, S5, S10, S50, S100, and S500. Therefore, the coin bar storage control section 60 is able to confirm the presence of the coin bars of the set coin types, based on whether or not the magnetic energy (magnetic data) detected by the magnetic sensors 70*c* provided in all of the set sections S1, S5, S10, S50, S100, and S500 match with reference magnetic energy (reference magnetic data) of the coin bars B1, B5, B10, B50, B100, and B500 of the set coin types within the allowable range. That is to say, in the set sections S1, S5, S10, S50, S100, and S500, if the coin bar of the set coin type is set, then the magnetic energy (magnetic data) corresponding to the set height detected by the magnetic sensor 70*c* is equal to the reference magnetic energy (reference magnetic data) corresponding to the reference set height. If a coin bar of a diameter smaller than that of the coin bar of the set coin type is set, then the magnetic energy (magnetic data) corresponding to the set height detected by the magnetic sensor 70*c* is lower than the reference magnetic energy (reference magnetic data) corresponding to the reference set height. If a coin bar of a diameter greater than that of the coin bar of the set coin type is set, then the magnetic energy (magnetic data) corresponding to the set height detected by the magnetic sensor 70*c* is higher than the reference magnetic energy (reference magnetic data) corresponding to the reference set height.

If the error margin between the magnetic energy (magnetic data) detected by the magnetic sensor 70*c* and the reference magnetic energy (reference magnetic data) of a coin bar of the set coin type falls within the allowable range, then it is determined that the coin bar of the set coin type is present. On the other hand, if the error margin between the magnetic energy (magnetic data) detected by the magnetic sensor 70*c* and the reference magnetic energy (reference magnetic data) of a coin bar of the set coin type does not fall within the allowable range, then it is determined that the coin bar of the set coin type is absent (that no coin bar is present, or a coin bar other than the coin bar of the set coin type (including an other object) is present).

More specifically, this is determined for example as described below. If the error margin between the detected magnetic energy (detected magnetic data) detected by the magnetic sensor 70*c* of the set section S10 for the ten-yen coin bar B10 and the reference magnetic energy (reference magnetic data) of the ten-yen coin bar B10 falls within the allowable range, then it is determined that the ten-yen coin bar B1 is present. On the other hand, if this error margin does not fall within the allowable range, then it is determined that no ten-yen coin bar B10 is present. If the error margin between the detected magnetic energy (detected magnetic data) detected by the magnetic sensor 70*c* of the set section S100 for the one-hundred-yen coin bar B100 and the reference magnetic energy (reference magnetic data) of the one-hundred-yen coin bar B100 falls within the allowable range, then it is determined that the one-hundred-yen coin bar B100 is present. On the other hand, if this error margin does not fall within the allowable range, then it is determined that no one-hundred-yen coin bar is present.

For the magnetic sensor 70*c*, detected magnetic energy (detected magnetic data) is varied by differences in set heights. Furthermore, detected magnetic energy (detected magnetic data) is also varied by differences in materials. As a result, even in the case where there are equal outer diameters and equal set heights, if the material is different, then the detected magnetic energy (detected magnetic data) differs from the reference magnetic energy (reference magnetic data). Accordingly, by making use of the magnetic sensor 70*c*, whether or not it is the set coin type can be determined based on the set height and the material thereof.

That is to say, if the error margin between the magnetic energy (magnetic data) detected by the magnetic sensor 70*c* and the reference magnetic energy (reference magnetic data) of a coin bar of the set coin type falls within the allowable range, then it is determined that the coin bar of the set coin type is present. On the other hand, if the error margin between the detected magnetic energy (detected magnetic data) detected by the magnetic sensor 70*c* and the reference magnetic energy (reference magnetic data) of a coin bar of the set coin type does not fall within the allowable range, then it is determined that the coin bar of the set coin type is absent (that no coin bar is present, or that a coin bar other than the coin bar of the set coin type (including an other object) is present). Furthermore, coin bars that have the same outer diameters and that are of different materials, other than this set coin type can also be detected.

The coin bar storage control section 60 detects a present amount of coin bars within the coin bar storage 14 in a manner similar to that of the second embodiment, based on the detection results of all of the magnetic sensors 70*c*.

The coin bars B1, B5, B10, B50, B100, and B500 configured by packing coins of prescribed diameters respectively have different diameters that sufficiently enable identification of the coin types. Therefore, according to the third embodiment described above, the presence of coin bars of the set coin types is detected as described below. Making use of the differences in the outer diameters of the coin bars, the set heights in the set sections S1, S5, S10, S50, S100, and S500 are made different. Magnetic energy (magnetic data) of the coin bars set in the set sections S1, S5, S10, S50, S100, and S500 are detected by the magnetic sensors 70*c*. The presence of the coin bar of the set coin type is confirmed based on whether or not this detection result matches with the reference magnetic energy (reference magnetic data) of the coin bar of the set coin type within the allowable range. Therefore, with such a simple configuration, the presence of the coin bar of the set coin type can be reliably detected.

Since the magnetic characteristics of the coin bars are detected by the magnetic sensor 70*c*, a coin bar (including an other object) other than the set coin type coin bar that has the same outer diameter and that is of a different material, which cannot be detected in the second embodiment that uses the distance sensor 7*b*, can also be determined not a coin bar of the set coin type.

Next, a coin bar storage of a fourth embodiment of the present invention is described with reference to FIG. 10A to FIG. 10C, mainly focusing on the points different from those in the first embodiment. Components that are the same as those in the first embodiment are denoted by the same reference symbols, and descriptions thereof are omitted.

Figure 10A:
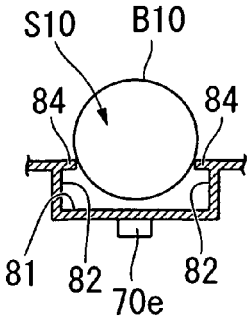
FIG. 10A is a sectional side view seen from one side showing a set section of a coin bar storage of a fourth embodiment of the present invention.
Figure 10B:
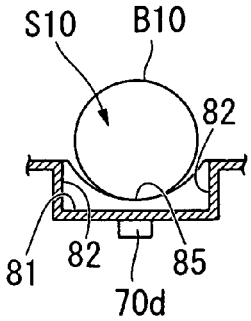
FIG. 10B is a sectional side view seen from the other side showing the set section of the coin bar storage of the fourth embodiment of the present invention.
Figure 10C:
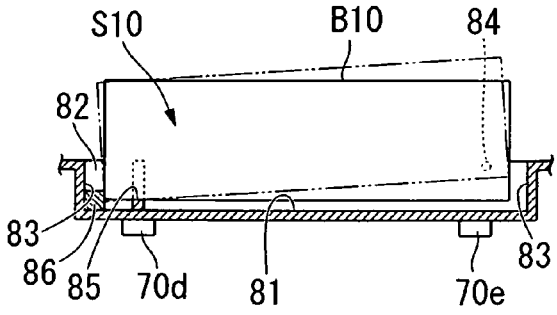
FIG. 10C is a sectional front view showing the set section of the coin bar storage of the fourth embodiment of the present invention.

In the fourth embodiment, as shown with an example of the set section S10 in FIG. 10A to FIG. 10C, each of the set sections S1, S5, S10, S50, S100, and S500 is of a concave shape that is concaved downward and has a bottom face 81, side faces 82, and end faces 83. The bottom face 81 is of a rectangular flat plate shape, the width of which is greater than the outer diameter of a coin bar of a set coin type to be set, and the depth of which is longer than the length of the coin bar, thereby enabling storage of the coin bar. The side faces 82 are formed so as to respectively rise vertically from both of the long sides of the bottom face 81. The end faces 83 are formed so as to respectively rise vertically from both of the short sides of the bottom face 81. On one side in the axial direction, there are provided a pair of supporting points 84. The pair of supporting points 84 is positioned at the same height having a gap therebetween narrower than the outer diameter of the coin bar of the smallest diameter, and in addition, they are arranged so that their positions in the axial direction are aligned. On the other side in the axial direction, there is provided a supporting section 85. The supporting section 85 is of an arc shape, the diameter of which is greater than the outer diameters of the coin bars of all of the coin types. With such a configuration, the set heights of the coin bars become constant in the one position on the supporting section 85 regardless of their outer diameters. The set heights are different in the other position on the supporting points 84, depending on the outer diameters of the coin bars. On the supporting section 85 side, there is provided a positioning section 86 for determining the position of the coin bar in the axial direction. The positioning section 86 may be provided on the supporting points 84 side.

The coin bars of the set coin types that are set in the set sections S1, S5, S10, S50, S100, and S500 are three-point supported. That is to say, one end section of the coin bar that has been set is in contact with the positioning section 86, the axial direction one side of the coin bar is supported on the pair of supporting points 84, and the other side in the axial direction is supported on the supporting section 85. The positional relationship between the positioning section 86, the supporting section 85, and the pair of supporting points 84 is set, so that the coin bar of the set coin type becomes horizontal and the axial direction center of the coin bar is positioned in the center between the supporting section 85 and the supporting points 84 while being supported on three points, as shown with the solid line in FIG. 10C. Accordingly, if a coin bar of a diameter greater than that of the coin bar of the set coin type is set while one end section thereof is in contact with the positioning section 86, then the coin bar is angled so that the supporting position side on the supporting points 84 is positioned higher than the positioning section 86 side as shown with the two-dot chain line in FIG. 10C. On the other hand, if a coin bar of a diameter smaller than that of the coin bar of the set coin type is set while one end section thereof is in contact with the positioning section 86, then the coin bar is angled so that the supporting position side on the supporting points 84 is positioned lower than the positioning section 86 side.

In all of the set sections S1, S5, S10, S50, S100, and S500, there are provided two magnetic sensors (set coin type presence confirmation sections) 70*d* and 70*e* spaced apart in the axial direction of the coin bar to be set. The magnetic sensor 70*d* is arranged in a position of the supporting section 85 at which the set height is constant regardless of the outer diameter of the set coin bar. In the supporting section 85, the set height is constant regardless of the outer diameter of the set coin bar. The magnetic sensor 70*e* is provided in a position of the pair of supporting points 84. In the pair of supporting points 84, a set height is different depending on the outer diameter of the set coin bar. These two sensors 70*d* and 70*e* are arranged on the bottom face 81 so that the distances therefrom to the coin bar are equal when the coin bar of the set coin type is set. Therefore, when the coin bar of the set coin type is set, detection results outputted respectively from these two sensors 70*d* and 70*e* are balanced. The magnetic sensors 70*d* and 70*e* employ for example an eddy-current type chip coil device. A sensor circuit (not shown in the drawing) to which the magnetic sensors 70*d* and 70*e* are connected is of a differential type in which a common balance coil is used for each of the magnetic sensors 70*d* and 70*e*, and it is a type in which scanning of the magnetic sensors 70*d* and 70*e* are carried out in a time division manner.

The coin types of the coin bars; B1, B5, B10, B50, B100, and B500 to be set are pre-set to all of the set sections S1, S5, S10, S50, S100, and S500. Therefore, the coin bar storage control section 60 is capable of detecting the presence of the coin bars based on magnetic energy (magnetic data, detection results) detected by the magnetic sensors 70*d* and 70*e* provided in all of the set sections S1, S5, S10, S50, S100, and S500. Furthermore, the coin bar storage control section 60 confirms the balance of these magnetic energy (magnetic data) to confirm the presence of coin bars of the set coin type based on whether or not error margin between the detected magnetic energy (detected magnetic data, detected result) detected by the magnetic sensor 70*d* and detected magnetic energy (detected magnetic data, detected result) detected by the magnetic sensor 70*e* is within an allowable range. In other words, the balance of the magnetic energy (magnetic data) detected by the magnetic sensors 70*d* and 70*e* is confirmed. As a result, if these differences fall within the allowable range that is set with respect to a coin bar of the set coin type, then it is determined that the coin bar of the set coin type is present. On the other hand, if these differences do not fall within the allowable range, then it is determined that there is no coin bar of the set coin type (or that a coin bar other than the set coin type coin bar (including an other object) is present).

For example, the case where a coin bar with an outer diameter that is greater than that of a coin bar of the set coin type is described below. In this case, whereas there is a predetermined distanced between the magnetic sensor 70*d* on the supporting section 85 side and the coin bar, the distance between the magnetic sensor 70*e* on the supporting points 84 side and the coin bar is greater than this predetermined distance. As a result, the balance between the magnetic energy (magnetic data, detection results) detected by the magnetic sensors 70*d* and 70*e* is impaired. Also if a coin bar with an outer diameter that is smaller than that of a coin bar of the set coin type is set, the balance in the magnetic energy (magnetic data, detection results) detected by the magnetic sensors 70*d* and 7*e* is impaired. This is because, whereas the distance between the magnetic sensor 70*d* on the supporting section 85 side and the coin bar is constant, the distance between the magnetic sensor 70*e* on the supporting points 84 side and the coin bar is shorter than this constant distance.

More specifically, this is determined for example as described below. If the difference in the detected magnetic energy (detected magnetic data) of the magnetic sensors 70*d* and 70*e* of the set section S10 for the ten-yen coin bar B10 is within the allowable range for the ten-yen coin bar B10, then it is determined that the ten-yen coin bar B10 is present. On the other hand, if this difference in the energy (data) does not fall within the allowable range, then it is determined that no ten-yen coin bar B10 is present. If the difference in the detected magnetic energy (detected magnetic data) of the magnetic sensors 70*d* and 70*e* of the set section S100 for the one-hundred-yen coin bar B100 is within the allowable range for the one-hundred-yen coin bar B100, then it is determined that the one-hundred-yen coin bar B100 is present. On the other hand, if this difference in the energy (data) does not fall within the allowable range, then it is determined that no one-hundred-yen coin bar B100 is present.

The coin bar storage control section 60 detects a present amount of coin bars within the coin bar storage 14 in a manner similar to that of the second embodiment, based on the detection results of all of the magnetic sensors 70*d* and 70*e*.

The coin bars B1, B5, B10, B50, B100, and B500 formed with packed coins of prescribed diameters respectively have different diameters that sufficiently enable identification of the coin types. Therefore, according to the fourth embodiment described above, the presence of coin bars of the set coin types is detected as described below. In a state where coin bars of the set coin types are set in the set sections S1, S5, S10, S50, S100, and S500, the outputs of both of the magnetic sensors 70*d* and 70*e* is balanced. On the other hand, in other states, the balance of the outputs of both of the magnetic sensors 70*d* and 70*e* is impaired. As described above, the coin bar storage control section 60 confirms the presence of a coin bar of the set coin type based on whether or not the outputs of these two magnetic sensors 70*d* and 70*e* are balanced. Therefore, with such a simple configuration, the presence of the coin bar of the set coin type can be reliably detected.

The balance of outputs from such two magnetic sensors 70*d* and 70*e* also occurs even in the case where the difference in diameters is small. Accordingly, the presence of a coin bar of the set coin type can be reliably detected. Exogenous noise can be canceled by observing the balance in the outputs of these two magnetic sensors 70*d* and 70*e*. As a result, reliability of the detection results is improved.

While preferred embodiments of the present invention have been described and illustrated above, it should be understood that the present invention is not limited to these embodiments. Additions, omissions, substitutions, and other modifications may be made without departing from the spirit or scope of the present invention. Accordingly, the present invention is not to be considered as being limited by the foregoing description, and is only limited by the scope of the appended claims.

What is claimed is:

1. A coin bar storage comprising:

a casing;

a coin bar tray that is provided in said casing so as to be drawn out from and stored into said casing, and that has a plurality of set sections in which set coin types are respectively pre-set to assign a coin type to each of said set sections;

a plurality of set coin type presence confirmation sections, each of which is provided in a corresponding one of said set sections of said coin bar tray, each of said set coin type presence confirmation sections confirming whether or not a coin bar of the set coin type is set in the corresponding one of said set sections, and outputting a confirmation result which indicates whether or not a coin bar of the set coin type is set; and a management section that manages a present amount of coin bars in said coin bar tray based on the confirmation result from each of said set coin type presence confirmation sections, wherein each of said set sections includes: a bottom face having a rectangular shape; a pair of supporting points provided on one side in a long side direction of the bottom face and having a gap therebetween; and a supporting section provided on an opposite side to the one side in the longitudinal direction of the bottom face and having an arc shape, each of said set coin type presence confirmation sections includes two magnetic sensors that detect a magnetic characteristic of a set coin bar that is set in said set section and that respectively output a detection result, and said two magnetic sensors are arranged on the bottom face and spaced apart in the long side direction so that one of the two magnetic sensors is arranged on the opposite side, said two magnetic sensors are configured such that in a case where a coin bar of a set coin type is set in said set section, an error margin between a detection result from the one of said two magnetic sensors and a detection result from the other of said two magnetic sensors is within an allowable range, and each of said set coin type presence confirmation sections further includes a confirmation section which confirms whether or not a coin bar of a set coin type is set in said set section based on whether or not the error margin between the detection results is within the allowable range.

2. A coin bar storage according to claim 1, further comprising a storage detection section that detects an open-closed switching from an open state where said coin bar tray is drawn out from said casing into a closed state where said coin bar tray is stored into said casing, wherein said management section detects the present amount when the open-closed switching is detected by said storage detection section.

3. A coin bar storage according to claim 1, further comprising a power supply monitoring section that detects an OFF-ON switching of an external power supply from OFF to ON, wherein said management section detects the present amount when said OFF-ON switching is detected by said power supply monitoring section.

* * * * *